US009180344B2

(12) United States Patent
Aoyama

(10) Patent No.: US 9,180,344 B2
(45) Date of Patent: Nov. 10, 2015

(54) MULTI-ARM DIMPLE AND DIMPLE PATTERNS INCLUDING SAME

(71) Applicant: Acushnet Company, Fairhaven, MA (US)

(72) Inventor: Steven Aoyama, Fairhaven, MA (US)

(73) Assignee: Acushnet Company, Fairhaven, MA (US)

( * ) Notice: Subject to any disclaimer, the term of this patent is extended or adjusted under 35 U.S.C. 154(b) by 277 days.

(21) Appl. No.: 13/740,524

(22) Filed: Jan. 14, 2013

(65) Prior Publication Data

US 2014/0200099 A1 Jul. 17, 2014

(51) Int. Cl.
*A63B 37/14* (2006.01)
*A63B 37/00* (2006.01)

(52) U.S. Cl.
CPC ..... *A63B 37/0007* (2013.01); *A63B 37/001* (2013.01); *A63B 37/0003* (2013.01); *A63B 37/0006* (2013.01); *A63B 37/0012* (2013.01); *A63B 37/0021* (2013.01)

(58) Field of Classification Search
USPC ..... 473/379–385
See application file for complete search history.

(56) References Cited

U.S. PATENT DOCUMENTS 878,254 A * 2/1908 Taylor ..... 473/384
1,681,167 A * 8/1928 Beldam ..... 473/383
4,090,716 A * 5/1978 Martin et al. ..... 473/379
4,560,168 A * 12/1985 Aoyama ..... 473/379
4,830,378 A * 5/1989 Aoyama ..... 473/384
4,869,512 A * 9/1989 Nomura et al. ..... 473/383
4,960,282 A * 10/1990 Shaw ..... 473/379
5,016,887 A * 5/1991 Jonkouski ..... 473/379
5,174,578 A * 12/1992 Oka et al. ..... 473/384
5,338,039 A * 8/1994 Oka et al. ..... 473/384
5,377,989 A * 1/1995 Machin ..... 473/379
5,470,076 A * 11/1995 Cadorniga ..... 473/384
5,566,943 A * 10/1996 Boehm ..... 473/378
5,735,757 A * 4/1998 Moriyama ..... 473/384
5,842,937 A * 12/1998 Dalton et al. ..... 473/384
5,957,786 A * 9/1999 Aoyama ..... 473/379
6,162,136 A * 12/2000 Aoyama ..... 473/383
6,290,615 B1 * 9/2001 Ogg ..... 473/378
6,315,686 B1 * 11/2001 Barfield ..... 473/383
6,331,150 B1 * 12/2001 Ogg ..... 473/383
6,409,615 B1 * 6/2002 McGuire et al. ..... 473/383
6,471,605 B2 * 10/2002 Ogg ..... 473/383
6,475,106 B1 * 11/2002 Green et al. ..... 473/383
6,569,038 B2 * 5/2003 Sullivan ..... 473/383
6,599,204 B2 * 7/2003 Kasashima et al. ..... 473/383
6,749,525 B2 * 6/2004 Aoyama ..... 473/383
6,843,736 B2 * 1/2005 Kasashima ..... 473/383
6,905,426 B2 * 6/2005 Morgan et al. ..... 473/383
6,958,020 B1 * 10/2005 Ogg et al. ..... 473/383
7,229,364 B2 * 6/2007 Aoyama ..... 473/383

* cited by examiner

*Primary Examiner* — Alvin Hunter

(74) *Attorney, Agent, or Firm* — Smith, Gambrell & Russell, LLP

(57) ABSTRACT

A golf ball dimple having a plurality of arms wherein each arm includes a leading edge, a trailing edge, side walls, and a sloped floor. The dimples of the invention may be included in a dimple pattern that may also include other types of dimples.

20 Claims, 9 Drawing Sheets

Section A-A of divergent ramp

Section A-A of divergent ramp

MULTI-ARM DIMPLE AND DIMPLE PATTERNS INCLUDING SAME

FIELD OF THE INVENTION

This invention relates to golf ball dimple designs having a star-like pattern and a method of distributing such dimples on a golf ball.

BACKGROUND OF THE INVENTION

A NACA duct is a common form of low-drag intake design, originally developed by the National Advisory Committee for Aeronautics during the 1940s. In particular, a NACA duct is a flush mounted inlet or scoop that is commonly used to supply cooling, ventilation, or combustion air to the mechanical systems of air and land vehicles. Since the NACA duct is a depression in the body's surface, as opposed to a traditional scoop that protrudes outside the body, the duct produces less drag. However, a disadvantage of such a configuration is that, since the duct does not reach out into the high energy air farther away from the body, a large proportion of low energy boundary layer air, i.e., the layer of air that clings to the surface or a moving body, is drawn in which reduces the effectiveness of the duct. NACA ducts partially counteract this disadvantage by incorporating certain geometric features. For example, a NACA duct consists of a ramp that gently slopes downward into the body. In addition, the ramp is narrow at its leading edge, but widens dramatically at its trailing edge. The increasing width is bounded by vertical or near-vertical side walls that have a characteristic reflex curvature. These S-shaped walk are a defining characteristic of the NACA duct and are believed to generate a pair of counter-rotating vortices that efficiently draw higher energy air from outside the boundary layer into the duct.

Race cars designers typically employ NACA ducts on lateral surfaces of the both to draw in air for less demanding applications such as ventilation or cooling. Aeronautical engineers employ NACA ducts on various types of aircraft for similar purposes. Applications such as combustion that require large volumes of high energy air are usually best served by conventional protruding scoops on the lateral surfaces of the body or inlets on the front-facing surfaces.

The shape and depth change of the duct are critical for proper operation. When properly implemented, it allows fluid (usually air) to be drawn into an internal duct, with a minimal disturbance to the flow or increase in drag.

Golf ball dimples work by inducing turbulence in the boundary layer of the air adjacent to the surface of the golf ball. Compared to laminar boundary layers, turbulent boundary layers are better able to remain attached to the ball surface. Thus, the size of the wake behind the golf ball can be reduced if the boundary layer is turbulent rather than laminar, resulting in a reduction of pressure drag acting on the golf ball. Although turbulent boundary layers generate greater skin friction drag, this is dramatically outweighed by the reduction of pressure drag. However, manufacturers are still dedicated in their efforts to reducing pressure drag and minimize the corresponding increase in skin friction drag to maximize the net benefit. Accordingly, there is a need in the art for improved dimple designs and geometry that induce turbulence in the boundary layer by drawing the air flow into the dimples. The present invention relates to such dimple designs and geometry.

SUMMARY OF THE INVENTION

The present invention is directed to a dimple for use on a golf ball including: a plurality of arms, wherein each arm includes: a leading edge having a first width; a trailing edge having a second width greater than the first width; a first side wall and to second side wall that each extend from the leading edge to the trailing edge; and a sloped floor, wherein the floor has a first depth at the leading edge that is substantially zero and a second depth at the trailing edge that is greater than the first depth to create a slope; and a center area, wherein the center area has a third depth around its perimeter that is the same as the second depth.

In one embodiment, the first and second side walls create a reflex curvature. In another embodiment, the first and second side walls each have a third width at a predetermined point along their length that is greater than the second width. In still another embodiment, the third width is at least about 3 percent greater than the second width. For example, the third width may be at least about 5 percent greater than the second width.

In another embodiment, the first and second side walls create a linear profile from the leading edge to the trailing edge. In still another embodiment, the first and second side walls each form an angle of about 90 degrees with the floor. In yet another embodiment, the first and second side walls each form an angle of greater than about 90 degrees and less than about 120 degrees with the floor.

The present invention is also directed to a golf ball including a plurality of dimples thereon, wherein the plurality of dimples is arranged on the golf ball according to a dimple pattern including at least one composite dimple, wherein the at least one composite dimple includes a plurality of arms, wherein each arm includes: a leading edge having a first width; a trailing edge having a second width greater than the first width; a first side wall and a second side wall that each extend from the leading edge to the trailing edge; and a sloped floor, wherein the floor has a first depth at the leading edge that is substantially zero and a second depth at the trailing edge that is greater than the first depth to create a slope; and a center area, wherein the center area has a third depth around its perimeter that is the same as the second depth.

In one embodiment, the dimple pattern includes at least about 50 percent of a first composite dimple type, wherein the first composite dimple type includes a first number of arms. In another embodiment, the dimple pattern includes at least about 1 percent of a second composite dimple type, wherein the second composite dimple type includes a second number of arms that is less than the first number of arms.

The dimple pattern may include at least about 50 percent of a first type of dimple having a first shape, wherein the dimple pattern includes about 5 percent to about 50 percent of a first composite dimple type having a first number of arms. In one embodiment, the first shape is circular. The dimple pattern may further include about 1 percent to about 5 percent, or a second composite dimple type, wherein the second composite dimple type has a second number of arms that is less than the first number of arms.

In one embodiment, the first and second side walls create a reflex curvature. In another embodiment, the first and second side walls each form an angle of about 90 degrees with the floor. In still another embodiment, the first and second side walls each form an angle of greater than about 90 degrees and less than about 120 degrees with the floor.

Each composite dimple may have the same number of arms as it has neighboring dimples. In one embodiment, the dimple pattern includes a plurality of composite dimples, and wherein the arms of the composite dimples are oriented to intermesh with the arms of neighboring composite dimples. In another embodiment, the dimple pattern includes a plurality of composite dimples, and wherein the arms of the composite dimples are oriented to straddle imaginary lines connecting the center of the dimple to the centers of neighboring dimples.

BRIEF DESCRIPTION OF THE DRAWINGS

Further features and advantages of the invention can be ascertained from the following detailed description that is provided in connection with the drawings described below:

FIG. 28 illustrates a top view of various embodiments of a portion of a dimple according to the present invention;

DETAILED DESCRIPTION OF THE INVENTION

As mentioned above, the present invention is directed to using the principles of NACA ducts to develop dimple designs and geometries for golf balls. In particular, a plurality of dimples formed using the principles of NACA duct technology may be used to form various dimple patterns that may be used on all or part of the golf ball surface.

Dimple Design

The dimple design for all or a portion of the dimples used on a golf ball according to the present invention may be generally based on NACA duct technology. In particular, the length and shape of at least one dimple on a golf ball according to the present invention is designed to draw air flow into the dimples and create counter-rotating vortices to increase turbulence in the boundary layer.

In one embodiment, composite dimples according to the invention include a plurality of substantially similar arms that each has a leading edge (the "pointed" portion) and a trailing edge. The arms converge together at a ring formed by the trailing edge of each. The ring defines the center area of the composite dimple. Accordingly, the leading edges of each arm protrude outward to create a dimple having a star-like geometry.

Figure 1A:
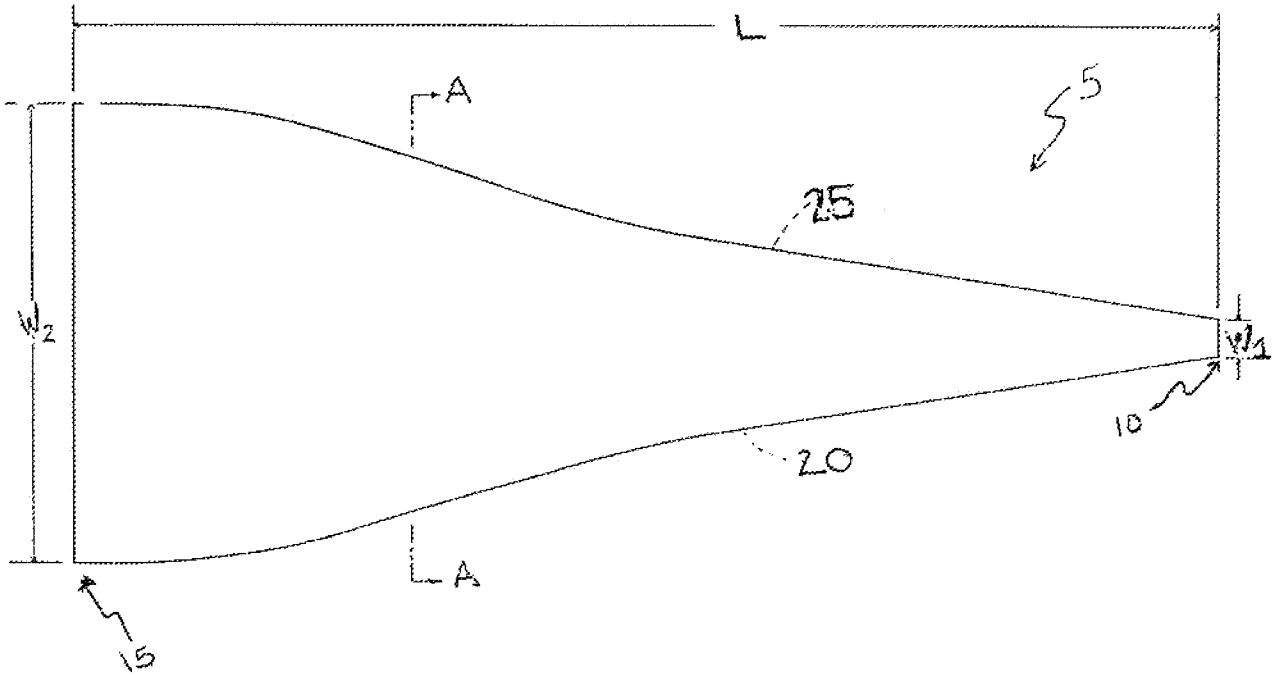
FIG. 1A illustrates a top view of one embodiment of a portion of a dimple according to the present invention.

FIG. 1A illustrates the general shape and contour of an arm 5. For example, the leading edge 10 of each arm 5 has a first width $W_1$ and the trailing edge 15 has a second width $W_2$ that is greater than the first width $W_1$. In one embodiment, the first width $W_1$ is about 50 percent or less of the second width $W_2$. In another embodiment, the first width $W_1$ is about 40 percent or less of the second width $W_2$. In still another embodiment, the first width $W_1$ is about 30 percent or less of the second width $W_2$. For example, the first width $W_1$ may be about 20 percent or less of the second width $W_2$. In one embodiment, the first width $W_1$ is about 10 percent or less of the second width $W_2$.

Figure 1B:
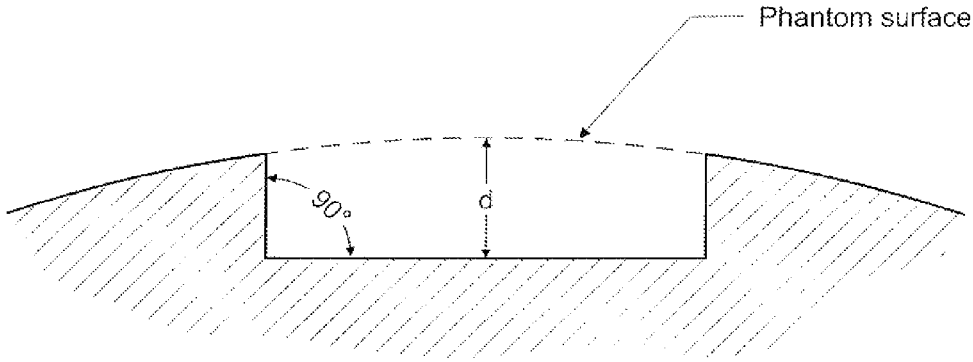
FIGS. 1B and 1C illustrate alternative cross sections of A-A in FIG. 1A.
Figure 1C:
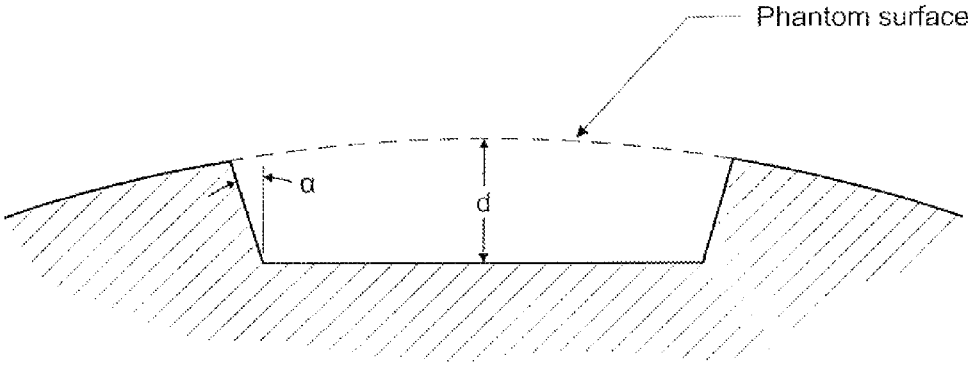

The increasing width from the leading edge 10 to the trailing edge 15 is bound on both sides with vertical or near-vertical side walls (20, 25), as shown in FIG. 1A. In particular, in one embodiment, the divergent side walls may form right angles (90°) with the floor of the arm, as shown in FIG. 1B. In another embodiment, the side walls are angled outward by angle α, as shown in FIG. 1C. For example, the side walls may be angled such that they create about a 95° to 120° angle with the floor of the arm. In one embodiment, the angle of the side wall is about 98° to about 110° from the floor of the arm. In another embodiment, the angle of the side wall is about 100° to about 105° from the floor of the arm.

One of ordinary skill in the art will understand that most golf balls are finished with one or more coats of paint which will alter the final plan and cross-sectional shapes of the dimples to a certain extent. Dimensions disclosed herein refer to the dimples in their unpainted state.

Figure 2A:
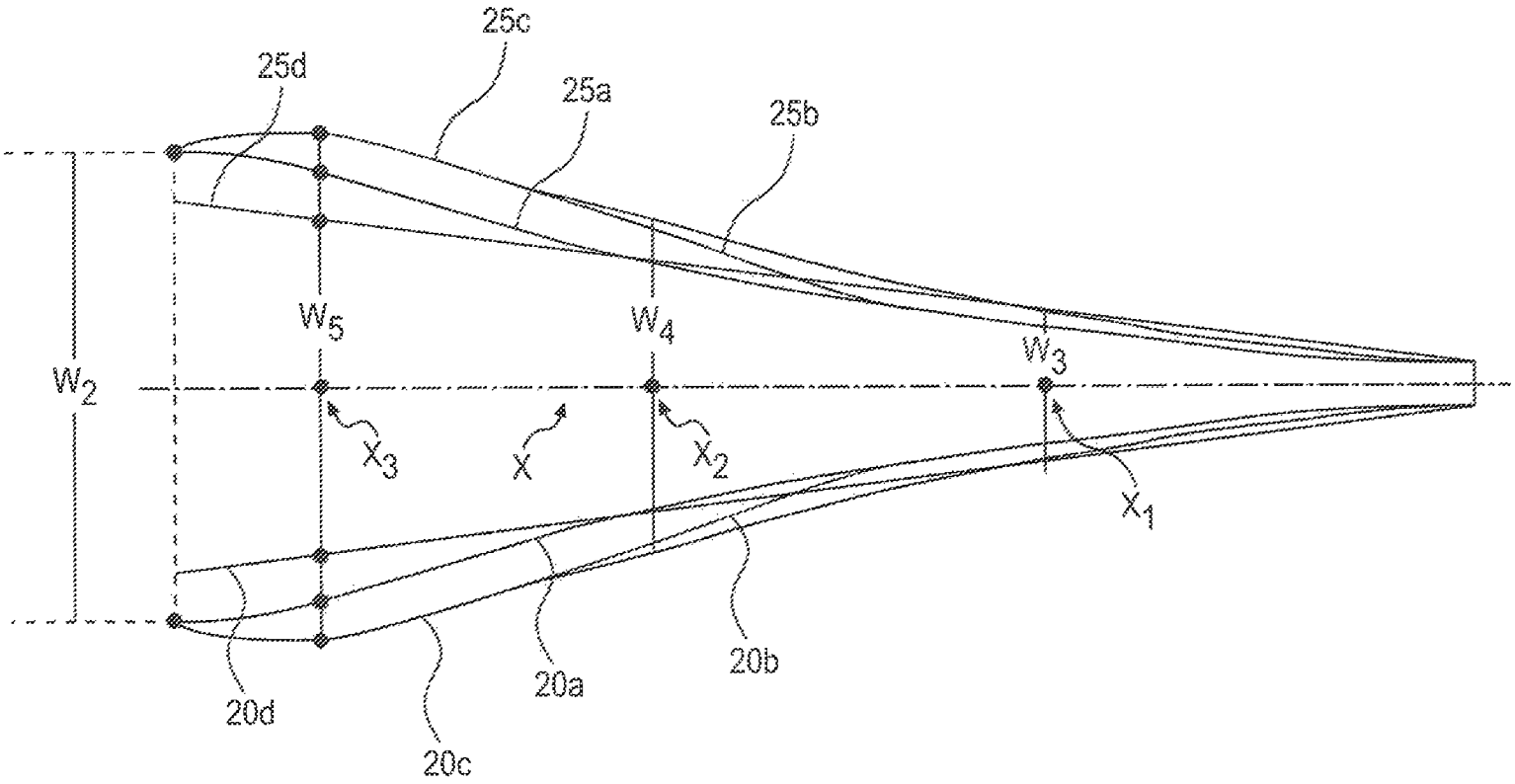
FIG. 2A illustrates a top view of another embodiment of a portion of a dimple according to the present invention.

The side walls 20, 25 of the arm may be curved. Several non-limiting examples of suitable curved side walls are shown in FIG. 2A. For example, the side walls 20*a* and 25*a* create a reflex curvature different from the reflex curvatures created by side walls 20*b* and 25*b* and side walls 20*c* and 25*c*. In particular, the side walls 20*a* and 25*a* create a narrower profile than the one created by side walls 20*b* and 25*b* (widths $W_4$ and $W_5$ (which represents the width from side wall to side wall at points $X_2$ and $X_3$, respectively) are less for side walls 20*a* and 25*a* than side walls 20*b* and 25*b* even though the width $W_3$ (which represents the width between the side walls at point $X_1$) and the width $W_2$ is the same for both side wall profiles). Similarly, the side walls 20*b* and 25*b* create a narrower overall profile than the one created by side walls 20*c* and 25*c* (widths $W_3$ and $W_4$ are less for side walls 20*b* and 25*b* than side walls 20*c* and 25*c* even though the width $W_2$ and $W_5$ are the same for both side wall profiles). In one embodiment, the curvature of the side walls creates a width $W_5$ that is greater than the width $W_2$ (side walls 20*b* and 25*b* and 20*c* and 25*c*).

In another embodiment, the profile created by the side walls is linear, as illustrated in FIG. 2A (side walls 20*d* and 25*d*). As such, the width $W_3$ created by side walls 20*d* and 25*d* is about equal to the width $W_3$ created by side walls 20*c* and 25*c*, but the widths $W_4$, $W_5$, and $W_2$ are less for side walls 20*d* and 25*d* than for side walls 20*c* and 25*c*.

Figure 2B:
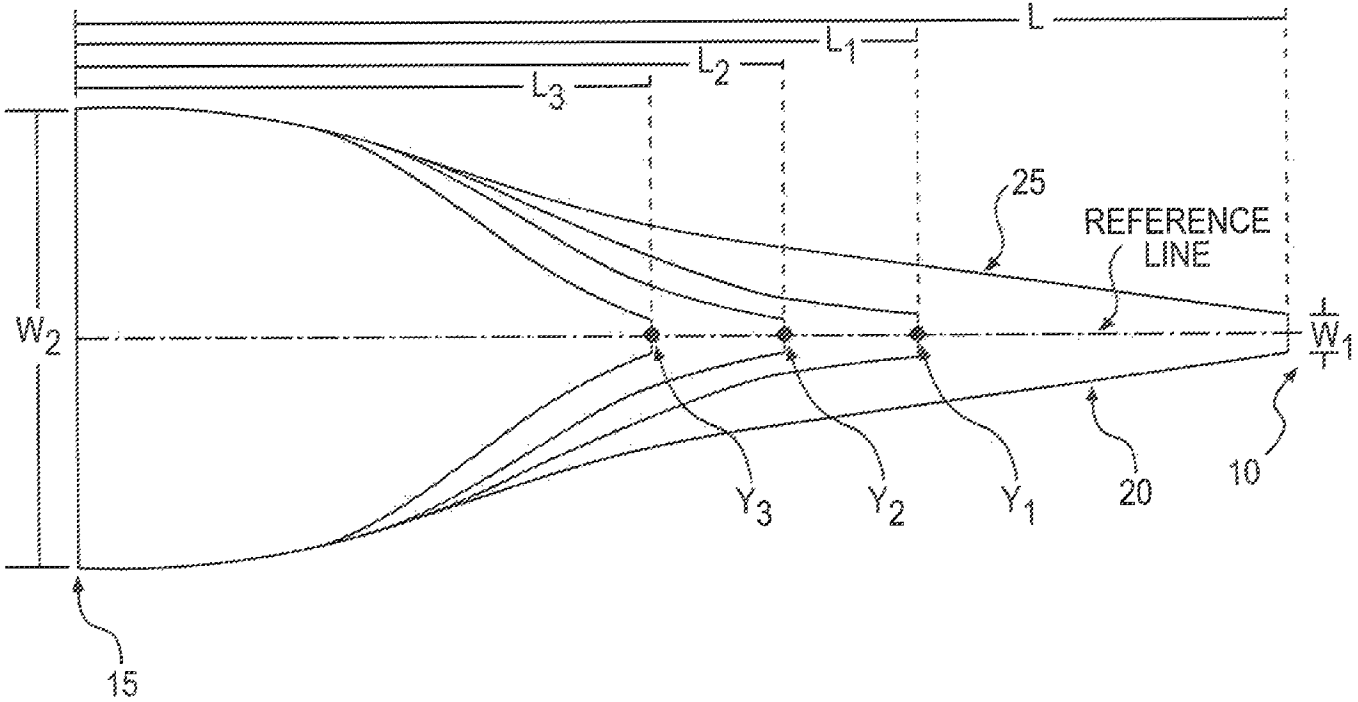

The length of the side walls of the arm may vary depending on the profile of the arm. For example, FIG. 2B illustrates the various lengths (L, $L_1$, $L_2$, and $L_3$) that the side walls may have depending on the profile of the arm. In particular, as illustrated in FIG. 2B, the side walls may have a length $L_1$ when the leading edge 10 begins at a point $y_1$ on the reference line. Likewise, the side walls may have a length L2 when the side leading edge 10 begins at point $y_2$ on the reference line.

Figure 3A:
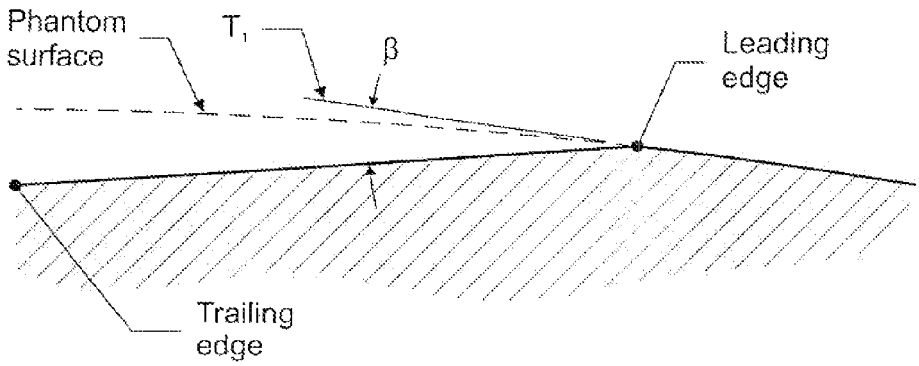
FIGS. 3A. 313 and 3C illustrate side cross-sectional views or elevations of various embodiments of a portion of a dimple according to the present invention.

As shown in FIGS. 1B and 1C, the depth d of the floor of the arm at any given point is the vertical distance between the phantom ball surface and the floor surface at a point midway between the side walls. As shown in FIG. 3A, the ramp like floor of the arm has essentially zero depth at the leading edge and a greater depth at the trailing edge, defining a ramp angle β between the tangent to the phantom ball surface $T_1$ and the ramp surface. The ramp angle of each arm may vary, but it should be understood that for best performance, less divergence should be used with larger ramp angles. In particular, the ramp angle may range from about 3° to about 15°. In one embodiment, the slope is about 5° to about 12°. In still another embodiment, the slope is about 7° to about 11.5°. In yet another embodiment, the slope ranges from about 8° to about 11.5°.

Figure 3B:
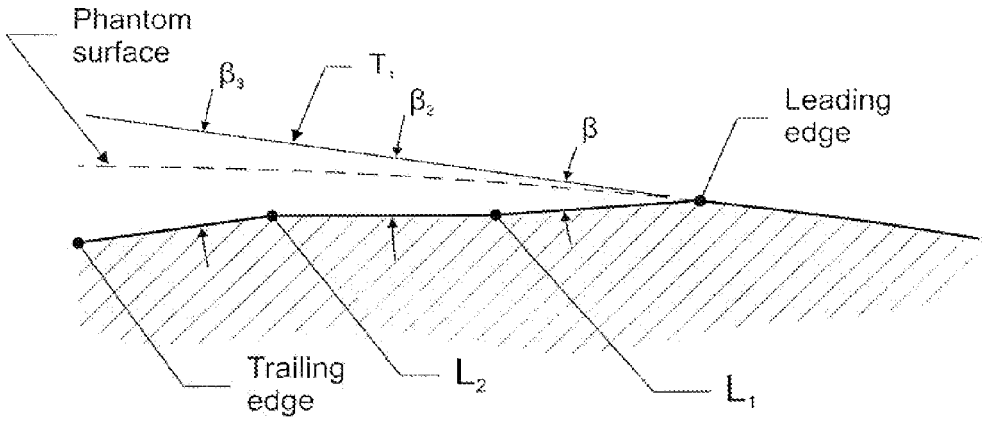

In another aspect, the floor of the arm may have two or more differing slopes from the leading edge to the trailing edge. For example, the arm may have a first slope from the leading edge 10 to a predetermined point, e.g., point $L_1$ in FIG. 3B, and a second slope from $L_1$ to the trailing edge 15. in this aspect, the second slope may be loss than the first slope.

For example, the second slope may be from about 3° to about 7° and the first slope may be from about 5° to about 12°. In another aspect, the arm may have three or more differing slopes as in FIG. 3B. For example, the arm may have a first slope from the leading edge to point $L_1$, a second slope from point $L_1$ to point $L_2$, and a third slope from point $L_2$ to the trailing edge. In one embodiment, the first slope ranges from about 3° to about 7°, the second slope ranges from about 2° to about 5°, and the third slope ranges from about 5° to about 12°. It should be understood that points $L_1$ and $L_2$ are intended to be for illustrative purposes only and one of ordinary skill in the art would be able to determine where the slopes should change angle for the best results.

Figure 3C:
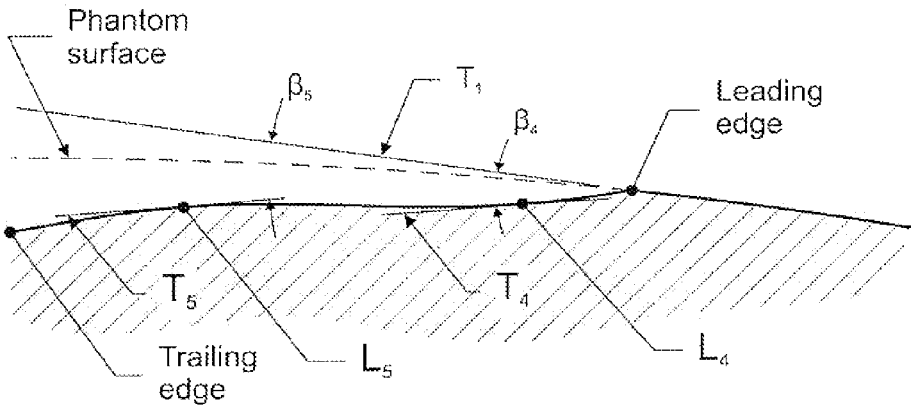

FIG. 3C shows another aspect. in which the floor of the arm may have continuous curvature rather than being composed of discrete sections having constant slopes. In this case, the slope at any given point such as $L_1$ or $L_5$ is measured between the phantom ball surface tangent $T_1$ and the local tangent to the floor surface $T_4$ or $T_5$. In one embodiment, the slope at any point ranges from 3° to 12°.

Figure 4:
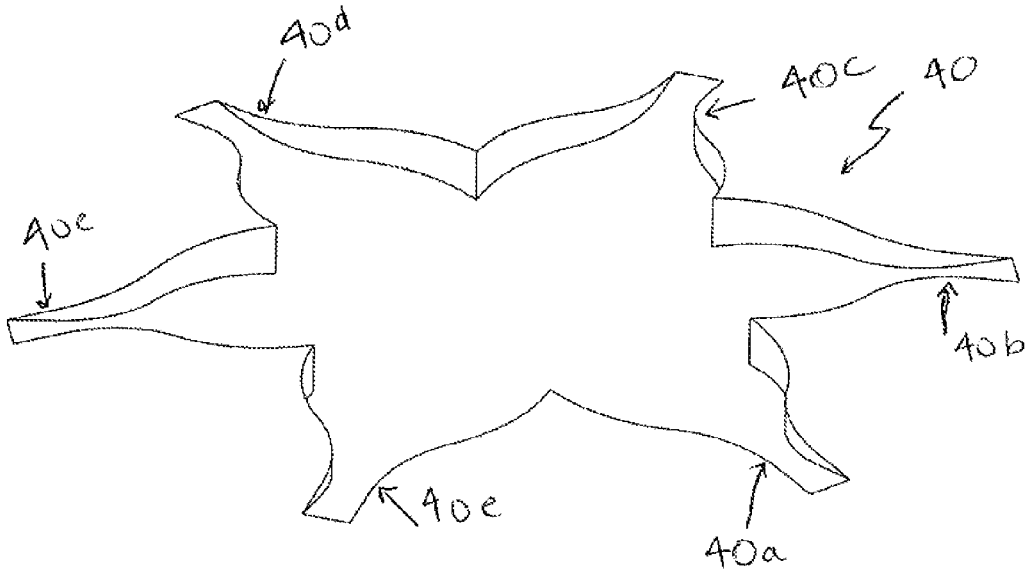
FIG. 4 illustrates a composite dimples according to an embodiment of the invention.

As mentioned above, a plurality of arms may form a composite dimple where the trailing edges form a ring around the center area of the resulting star-like shape. Without being bound by any particular theory, a composite dimple with a plurality of arms eliminates the need to specify the air flow direction. In one embodiment, the composite dimple has at least two arms. In another embodiment, the composite dimple has at least three arms. In another embodiment, the composite dimple has at least four arms. In yet another embodiment, the composite dimple has at least five arms. In still another embodiment, the composite dimple has at least six arms. For example, as shown in FIG. 4, the composite dimple 30 has six arms (40*a*-40*f*). In yet another embodiment, the dimple has more than six arms. The enclosed center area is preferably smooth and continuous with the surrounding ramps, although other configurations are contemplated. For example, bumps, annular rings, depressions, and the like are contemplated.

In addition, while the composite dimple 30 shown in FIG. 4 shows six substantially similar arms (40*a*-40*f*), it is contemplated that the arm width, side wall divergence profile, ramp angle, side wall length, and wall angle may vary within, each dimple. In other words, one or more arms of the dimple may have a different width and/or side wall divergence profile from the other arms. Likewise, one or more arms of the dimple may have a different ramp angle than the other arms. Similarly, one or more arms may have a 90° wall angle whereas other arms may have wall angles that are greater than 90°. And, one or more arms may have a side wall length that is different from the side wall length of the other arms.

Dimple Pattern

As mentioned above, the composite dimples of the invention may be arranged on the entire surface of the golf ball or portions thereof. In one embodiment, a plurality of dimples is arranged in a defined space such that the resulting dimple pattern includes at least one composite dimple according to the invention. The at least one composite dimple may be placed randomly on the designated surface or may be selected and arranged by any means known to those skilled in the art. In another embodiment, the plurality of dimples is arranged such that the resulting dimple pattern includes a plurality of composite dimples according to the invention where each dimple shape may be the same or different. In yet another embodiment, the plurality of dimples is arranged such that the resulting dimple pattern includes a plurality of composite dimples according to the invention and a plurality of dimples having a different shape.

In one embodiment, dimples cover approximately half of the surface of the ball. Of this coverage area, at least a portion includes the composite dimples of the invention. In another embodiment, composite dimples according to the invention may be placed on at least about 60 percent of the golf ball surface. The composite dimples may cover at least 70 percent of the golf ball surface. In one embodiment, the composite dimples cover at least 80 percent of the golf ball surface. In another embodiment, the composite dimples of the invention cover at least about 8 percent of the golf ball surface. In another embodiment, the composite dimples of the invention cover at least 90 percent of the surface of the golf ball.

Figure 5:
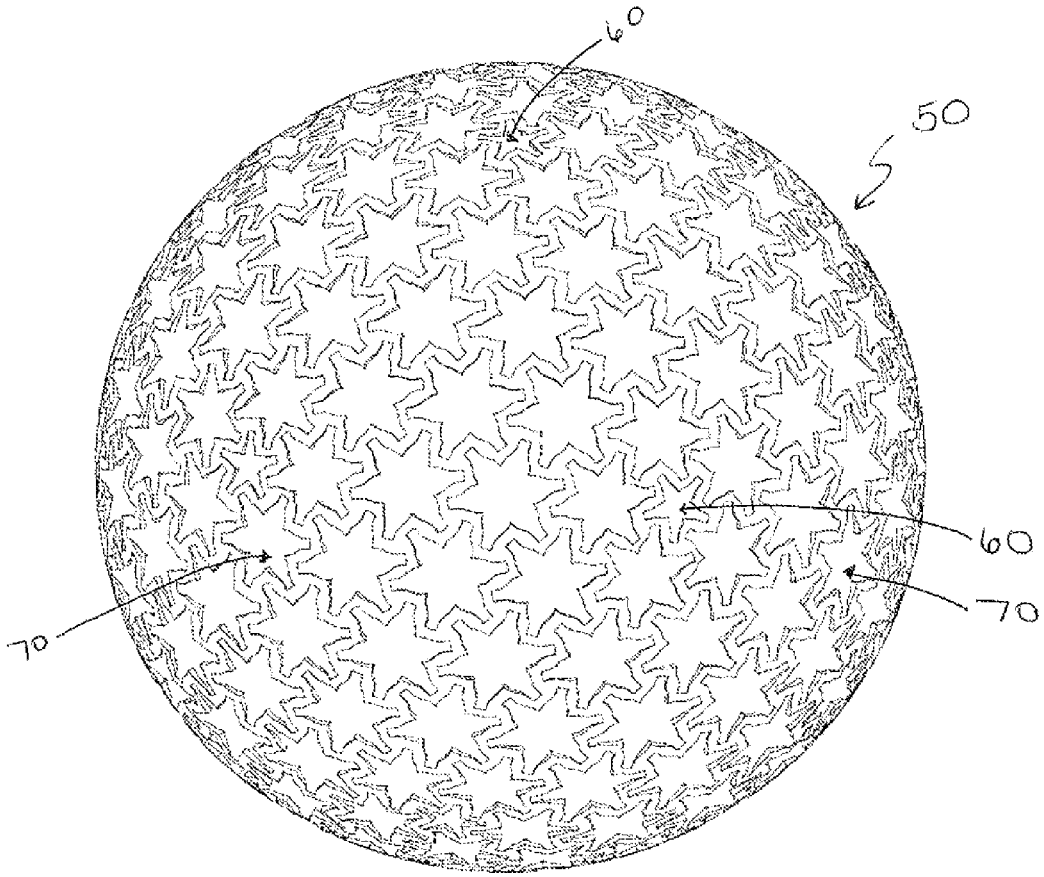
FIGS. 5-7 illustrate embodiments of dimple patterns including pluralities of composite dimples according to the present invention.

While one of ordinary skill in the art will appreciate that the composite dimples of the invention may be placed on the golf ball using any number of desired patterns or schemes known in the art, dimple patterns based on the geometry of an icosahedron are particularly suitable due the regularity of the dimple arrays produced. In particular, as shown in FIG. 5, the dimple pattern on golf ball 50 may be based on an icosahedron and include 252 dimples with 12 five-armed composite dimples 60 according to the invention that are located at the vertices of the icosahedron. The remaining area is filled with 240 six-armed composite dimples 70 according to the invention. In this particular example, the arms of the composite dimples are oriented to intermesh with the arms of neighboring dimples producing a tessellated effect. In an alternate embodiment, the arms are oriented to straddle the imaginary line connecting the center of the dimple to the centers of neighboring dimples, as shown in FIG. 6.

In one embodiment, the dimple pattern has composite dimples that have the same number of arms as they have neighboring dimples. For example, as shown in FIG. 6, dimple A (70) has six neighboring dimples ($A_1$, $A_2$, $A_3$, $A_4$, $A_5$, and $A_6$). Accordingly, dimple A has six arms. Similarly, dimple B (60) has five neighboring dimples ($B_1$, $B_2$, $B_3$, $B_4$, and $B_5$) and, thus, has five arms.

Figure 6:
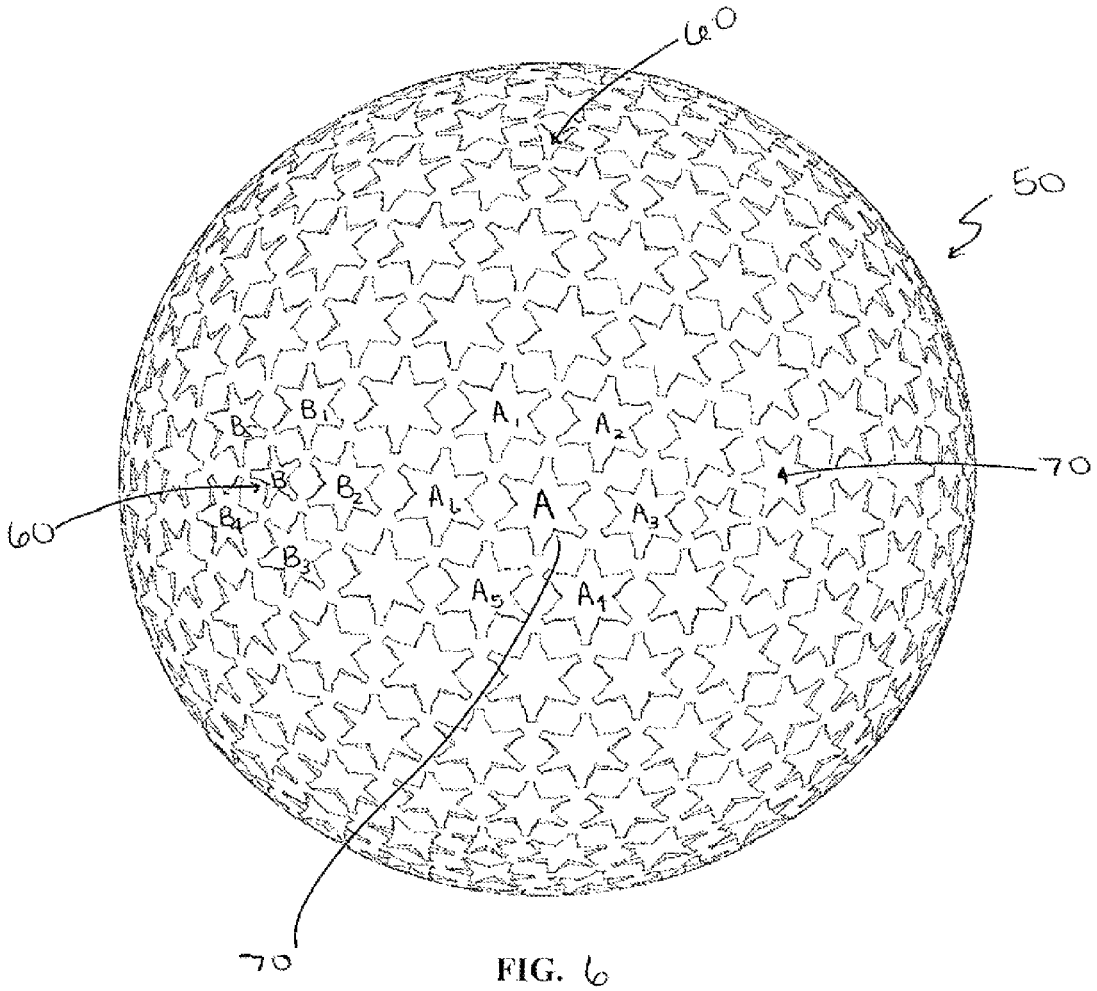

Those of ordinary skill in the art would understand that the specific embodiments shown in FIGS. 5 and 6 are intended to be non-limiting examples and that other patterns are within the scope and spirit of the invention. For example, a dimple pattern that includes only composite dimples may include any number of composite dimples having three arms, four arms, five arms, six arms, and more than six arms. In one embodiment, the dimple pattern includes at least about 50 percent six-armed composite dimples, based on the total number of composite dimples. In another embodiment, the dimple pattern includes at least about 75 percent six-armed composite dimples, based on the total number of composite dimples. In still another embodiment, the dimple pattern includes at least about 90 percent six-armed composite dimples, based on the total number of composite dimples. For example, the dimple pattern may include at least about 95 percent six-armed composite dimples.

Likewise, portions of the golf ball surface may be configured with dimples that are not shaped according to the methods described herein. For instance, the location and size of dimples on a golf ball corresponding to a vent pin or retractable pin for an injection mold may be selected in order to avoid significant retooling of molding equipment. Maintaining the selected size and position of such dimples may be accomplished by defining the portions of the ball where dimples will be arranged according to the methods described herein so that the defined portion of the ball surface excludes the dimples that are to remain in their selected position.

The present invention also contemplates dimple patterns where only a portion of the dimples on the surface of the ball are composite dimples of the invention. For example, in one embodiment, a dimple pattern that includes a mixture of composite dimples and other types of dimples may include between about 5 percent and about 50 percent composite dimples and about 95 percent and about 50 percent other types of dimples. In another embodiment, a suitable dimple pattern includes about 15 percent to about 35 percent composite dimples and about 85 percent to about 65 percent other types of dimples. In this aspect, the composite dimples may differ in the number of arms. For example, such a dimple pattern may include between about 1percent and about 10 percent five-armed composite dimples and about 15 percent to about 25 percent six-armed composite dimples.

The other type of dimple may be a conventional shape (such as a circular plane shape) or a non-circular shape such as oval, triangular, rhombic, rectangular, pentagonal, and polygonal. In one embodiment, the dimple pattern includes a plurality of composite dimples of the invention and a plurality of at least one other type of dimple placed in remaining portions or undefined spaces in any manner. For example, in one embodiment, the golf ball surface may include a first plurality of composite dimples formed according to the present invention having a first shape and a first size and a second plurality of dimples having a second shape and a second size. In another embodiment, the golf ball surface may include a first plurality of composite dimples formed according to the present invention having a first shape and a first size, a second plurality of composite dimples according to the present invention having a second shape and a second size, and a third plurality of dimples having a third shape and a third size.

In another embodiment, the dimple pattern includes a plurality of composite dimples of the invention and a plurality of at least two other types of dimple placed in remaining portions or undefined spaces in any manner, where the types of other dimples may be defined by different sizes of the same shape of dimple or different shapes in substantially similar or different sizes. For example, in one embodiment, the golf ball surface may include a first plurality of composite dimples formed according to the present invention having a first shape and a first size, a second plurality of dimples having a second shape and a second size, and a third plurality of dimples having a third shape and third size. In this aspect, the second and third shapes may be substantially the same or different. Likewise, the second and third sizes may be substantially the same or different. In one embodiment, the second shape is a circular plane shape and the third shape is a non-circular shape. In another embodiment, the second and third shapes may each be circular plane shapes where the second size is greater than the third size.

In another embodiment, the golf ball surface may include a first plurality of composite dimples formed according to the present invention having a first shape and a first size, a second plurality of composite dimples formed according to the present invention having a second shape and a second size, and at least a third plurality of dimples having a third shape and a third size, with the option to have additional pluralities of dimples having different shapes and/or sizes from the third plurality of dimples. In this aspect, the additional pluralities may have the same shape as the third shape, but a different size than the third size. In the alternative, the additional pluralities may have substantially the same size, but a different shape than the third shape. In addition, the additional pluralities may have a different shape and size than the third shape and size (and also different from each plurality's shape and size).

Figure 7:
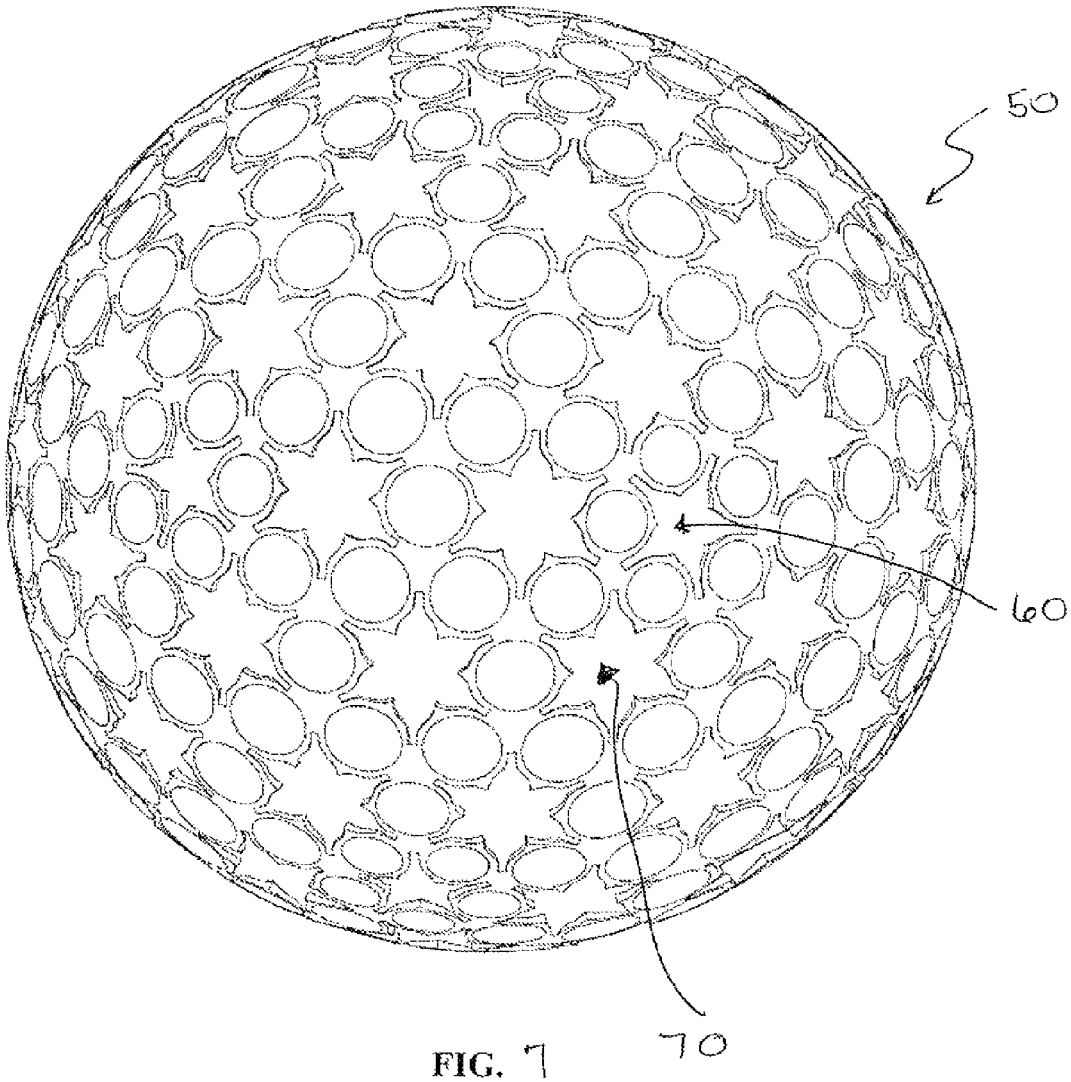

In the particular example shown in FIG. 7, the dimple pattern includes 362 total dimples: 12 five-armed composite dimples 60, 80 six-armed composite dimples 70, and 270 circular dimples. While the specific embodiment shown in FIG. 7 has about 25 percent of the dimples being composite dimples according to several embodiments of the invention, one of ordinary skill in the art would understood that the percent of composite dimples may be adjusted depending on the desired dimple pattern.

Several additional non-limiting examples of dimple sizes and shapes that may be used as the "other types of dimples" in the dimple patterns disclosed herein are provided in U.S. Pat. Nos. 6,358,161 and 6,709,349, the entire disclosures of which are incorporated by reference herein.

In addition to varying the perimeter and size of the "other types of dimples," the cross-sectional profile of such dimples may also be varied. For example, in one embodiment, the profile of the dimples corresponds to a catenary curve. This embodiment is described in further detail in U.S. Pat. No. 7,887,439, which is incorporated by reference herein in its entirety. Another example of a cross-sectional dimple profile that may be used with the present invention is described in U.S. Pat. No. 6,905,426, which also is incorporated by reference herein in its entirety. Other dimple profiles, such as spherical ellipsoidal, or parabolic, may be used as well without departing from the spirit and scope of the present invention. In addition, the dimples may have a convex or concave profile, or any combination thereof.

As mentioned above, the defined space for arranging the composite dimples of the invention on the surface of the ball may approximately correspond to a hemispherical portion of the golf ball, although smaller or larger regions also may be selected. Defining the space in this manner may have particular benefit when the mold that forms the cover is composed of two hemispherical halves.

The defined space may be selected to correspond approximately to the area formed by one mold cavity. In this situation, a boundary region may be imposed near the parting line of the mold so that the dimples are not formed too close to where the mold cavities meet. For instance, a boundary region may be imposed so that no portion of a dimple (composite or other type of dimple) is formed within 0.005 inches or less of the mold parting line. Preferably, this boundary region would be approximately the same distance from the parting line on the corresponding mold cavity.

This technique for defining the space to correspond to a mold cavity may be used even if the corresponding cavities of a pair do not have the same dimensions or configurations. For instance, the parting line of the mold may be offset, as described for instance in U.S. Pat. No. 4,389,365 to Kudriavetz, the disclosure of which is incorporated by reference in its entirety. Additionally, the parting line of the mold may not occur in a single plane, as described for example in U.S. Pat. No. 6,705,959, which is incorporated herein by reference. Other molds may have dimples that cross the parting line such described in U.S. Pat. No. 6,168,407, which is incorporated by reference in its entirety. It is not necessary, however, that the defined space is limited to the area formed by a single mold cavity. Often, the defined space is a smaller spherical polygonal area corresponding to a face of an inscribed polyhedron, as is well known in the art.

In an alternate embodiment, dimples (composite and/or other types) may be placed on the parting line.

The dimple pattern may also be chosen based on one or more geometric schemes including, but not limited to, Soddy circles, as described in U.S. Pat. No. 7,473,194, the entire disclosure of which is incorporated by referenced herein. The Soddy circles may be mapped onto the surface of the golf ball in any desired manner. Those skilled in the art will recognize that the present invention is not limited to any specific triangulated pattern or patterns. For instance, the triangles forming the triangulated pattern may comprise any angles including oblique, obtuse, equilateral, or any possible combinations thereof. The length of each side of the triangle may also be varied as desired. In addition, the present invention is not intended to be limited to any number of triangles within a specific region on the spherical surface. Moreover, the triangulated pattern may be mapped to the entire surface of the golf ball, or alternately it may be mapped to only a portion of the golf ball. The portion may or may not include the equator of the golf ball. In some embodiments, it may be desirable to use two or more different triangulated patterns to generate a dimple pattern. In such an embodiment, the two or more triangulated patterns may be mapped to different portions of the surface of the golf ball. It may be desirable to map two or more triangulated patterns to the same portion of the golf ball in order to generate yet another triangulated pattern based on their combination.

Golf Ball Construction

The present invention is not limited to any particular ball construction, nor is it restricted by the materials used to form the cover or any other portion of the golf ball. Thus, the invention may be used with golf balls having solid, liquid, or hollow centers, any number of intermediate layers and any number of covers. It also may be used with wound golf balls, golf balls having multilayer cores, and the like. For instance, the present invention may be used with a golf ball having a double cover, a dual core, and combinations thereof.

Other non-limiting examples of suitable types of ball constructions that may be used with the present invention include those described in U.S. Pat. Nos. 6,056,842, 6.824,476, 6,548,618, 5,688,191, 5,713.801, 5,803.831, 5,885,172. 5,919,100, 5,965,669, 5,981,654, 5,981,658, and 6.149,535. The entire disclosures of these patents and published applications are incorporated by reference herein.

The invention also is not limited by the materials used to form the golf ball. Examples of suitable materials that may be used to form different parts of the golf ball include, but are not limited to polyurea, polyurethane, polybutadiene, ionomer resins, and mixtures thereof. For example, the outer cover material may be formed from polyurethane, polyurea, and mixtures thereof.

Although the present invention has been described with reference to particular embodiments, it will be understood to those skilled in the art that the invention is capable of a variety of alternative embodiments within the spirit of the appended claims. For example, dimple patterns and resulting golf balls formed with the dimple patterns including composite dimples in accordance with the invention may include additional features, if desired, including features that are known and used in the art.

What is claimed is:

1. A dimple for use on a golf ball comprising:

a plurality of arms, wherein each arm comprises:

a leading edge having a first width;

a trailing edge having a second width greater than the first width;

a first side wall and a second side wall that each extend from the leading edge to the trailing edge; and a sloped floor, wherein the floor has a first depth at the leading edge that is substantially zero and a second depth at the trailing edge that is greater than the first depth to create a slope and wherein the first and second side walls each form an angle of about 90 degrees with the floor; and a center area, wherein the center area has a third depth around its perimeter that is the same as the second depth.

2. The dimple of claim 1, wherein the first and second side walls create a reflex curvature.

3. The dimple of claim 1, wherein the first and second side walls each have a third width at a predetermined point along their length that is greater than the second width.

4. The dimple of claim 3, wherein the third width is at least about 3 percent greater than the second width.

5. The dimple of claim 4, wherein the third width is at least about 5 percent greater than the second width.

6. The dimple of claim 1, wherein the first and second side walls create a linear profile from the leading edge to the trailing edge.

7. A golf ball comprising a plurality of dimples thereon, wherein the plurality of dimples is arranged on the golf ball according to a dimple pattern comprising at least one composite dimple, wherein the at least one composite dimple comprises a plurality of arms, wherein each arm comprises:

a leading edge having a first width;

a trailing edge having a second width greater than the first width;

a first side wall and a second side all that each extend from the leading edge to the trailing edge; and a sloped floor, wherein the floor has a first depth at the leading edge that is substantially zero and a second depth at the trailing edge that is greater than the first depth to create a slope and wherein the first and second side walls each form an angle of about 90 degrees with the floor; and a center area, wherein the center area has a third depth around its perimeter that is the same as the second depth.

8. The golf ball of claim 7, wherein the dimple pattern comprises at least about 50 percent of a first composite dimple type, wherein the first composite dimple type comprises a first number of arms.

9. The golf ball of claim 8, wherein the dimple pattern comprises at least about 1 percent of a second composite dimple type, wherein the second composite dimple type comprises a second number of arms that is less than the first number of arms.

10. The golf ball of claim 7, wherein the dimple pattern comprises at least about 50 percent of a first type of dimple having, a first shape, wherein the dimple pattern comprises about 5 percent to about 50 percent of a first composite dimple type having a first number of arms.

11. The golf ball of claim 10, wherein the first shape is circular.

12. The golf ball of claim 10, wherein the dimple pattern further comprises about 1 percent to about 5 percent of a second composite dimple type, wherein the second composite dimple type has a second number of arms that is less than the first number of arms.

13. The golf ball of claim 7, wherein the first and second side walls create a reflex curvature.

14. The golf ball of claim 7, wherein each composite dimple has the same number of arms as it has neighboring dimples.

15. The golf ball of claim 7, wherein the dimple pattern comprises a plurality of composite dimples, and wherein the arms of the composite dimples are oriented to intermesh with the arms of neighboring composite dimples.

16. The golf ball of claim 7, wherein the dimple pattern comprises a plurality of composite dimples, and wherein the arms of the composite dimples are oriented to straddle imaginary lines connecting the center of the dimple to the centers of neighboring dimples.

17. A dimple for use on a golf ball comprising:

a plurality of arms, wherein each arm comprises:

a leading edge having a first width;

a trailing edge having a second width greater than the first width;

a first side wall and a second side wall that each extend from the leading edge to the trailing edge; and a sloped floor, wherein the floor has a first depth at the leading edge that is substantially zero and a second depth at the trailing edge that is greater than the first depth to create a slope and wherein the first and second side walls each form an angle of greater than about 90 degrees and less than about 120 degrees with the floor; and a center area, wherein the center area has a third depth around its perimeter that is the same as the second depth.

18. The dimple of claim 17, wherein the first and second side walls create a reflex curvature.

19. The dimple of claim 17, wherein the first and second side walls each have a third width at a predetermined point along their length that is greater than the second width.

20. The dimple of claim 19, wherein the third width is at least about 3 percent greater than the second width.

* * * * *